US005566429A

United States Patent [19]

Martinez et al.

[11] Patent Number: 5,566,429

[45] Date of Patent: Oct. 22, 1996

[54] EXTRUDED ZIPPER WITH ORIENTING MEANS AND METHOD FOR ORIENTING SAME

[75] Inventors: David M. Martinez, Elmont; Paul A. Tilman, New City, both of N.Y.

[73] Assignee: Minigrip, Inc., Orangeburg, N.Y.

[21] Appl. No.: 325,811

[22] Filed: Oct. 19, 1994

[51] Int. Cl.[6] ..... B65D 33/24

[52] U.S. Cl. ..... 24/587; 24/576

[58] Field of Search ..... 24/399, 400, 575–577, 24/587; 383/63

[56] References Cited

U.S. PATENT DOCUMENTS

| | | | |
|---|---|---|---|
| 4,285,105 | 8/1981 | Kirkpatrick | 24/587 X |
| 4,731,911 | 3/1988 | Gould | 24/587 |
| 4,792,240 | 12/1988 | Ausnit | 24/587 X |
| 4,907,321 | 3/1990 | Williams | 24/587 |
| 4,957,571 | 9/1990 | Cipolla | 383/63 X |
| 5,138,750 | 8/1992 | Gundlach et al. | 24/587 |
| 5,185,909 | 2/1993 | Inagaki | 24/587 |
| 5,248,201 | 9/1993 | Kettner et al. | 24/587 X |
| 5,356,222 | 10/1994 | Kettner et al. | 24/587 X |

*Primary Examiner*—Peter M. Cuomo
*Assistant Examiner*—Robert J. Sandy
*Attorney, Agent, or Firm*—Kane, Dalsimer, Sullivan, Kurucz, Levy, Eisele and Richard, LLP

[57] ABSTRACT

A string zipper is provided for use in the manufacture of material for reclosable plastic bags. The string zipper includes a first profile and a complementary mating profile which, when interlocked and properly attached to the bag walls render the bag easy to open from the outside and hard to open from the inside. One of the profiles is formed of polyethylene material that includes an optical brightener to facilitate properly orienting the zipper on a sheet of plastic material. During manufacture of plastic bag material, the zipper is passed through a black light so that the profile containing the brightener can be detected and thus the profiles may readily be distinguished from one another and properly oriented on the sheet material to obtain the desired force differential feature on the final bag.

5 Claims, 1 Drawing Sheet

EXTRUDED ZIPPER WITH ORIENTING MEANS AND METHOD FOR ORIENTING SAME

BACKGROUND OF THE INVENTION

The present invention relates generally to the reclosable plastic bag art and in particular to string zipper used in a method of manufacture of such bags.

The common reclosable plastic bag is provided on one bag sidewall with an extruded profile that interlocks with a complementary mating profile on the opposite sidewall. The profile configurations or method of attachment is such that a greater force is required to open the bag from within than from without. As a result, the bag is rendered relatively easy for the user to open while being capable of resisting internal forces when filled that otherwise would cause the bag to "pop" open.

The force differential required to provide the aforementioned easy-from-outside, hard-from-inside opening operation of the reclosable bag may be obtained by properly configuring the profiles, such as by providing asymmetric male and/or female profiles (for example as disclosed in U.S. Pat. No. 3,198,228) or by providing a post or other means to make opening the bag easier from the outside than the inside (for example as disclosed in U.S. Pat. No. 4,736,451). In either case, the orientation of the zipper on the bag walls is critical to insure that the easy open side is directed toward the bag opening and away from the bag interior.

Reclosable plastic bags are commonly formed of a sheet of plastic material on which the profiles are integrally extruded or to which separately extruded profiles are bonded. The sheet material is formed into a tube, folded flat with the profiles joined and transverse seals are formed to provided the sides for adjacent bags.

Where the profiles are formed integrally with the sheet material their orientation is properly predetermined by the position of the profile dies. However, where the profiles are separately formed and then attached to a sheet, extreme care must be exercised to insure the proper orientation of the profiles. The zipper to be applied to the sheet may be provided with base flanges adjacent to one or both of the profiles or the profiles may be flangeless, providing a so-called "string zipper". A typical string zipper construction is depicted, for example in U.S. Pat No. 5,276,950. In either case, the zipper is usually shipped to a bag converter wound on a spool which is unwound at the zipper attachment equipment station. The zipper attachment equipment may be a stand-alone device or part of a bag fabricating or form, fill and seal machine. In either case, the zipper is usually provided with the profiles already engaged and the profiles remain engaged throughout the bag forming operation until the bag is first opened by an eventual user.

For a conventional reclosable storage bag or formed, filled and sealed food package, the base of the profiles and hence the width of the zipper is on the order of 0.250". Thus, the differences between the easy and hard open sides is quite minute and difficult to detect. The zipper is commonly wound on a spool of sufficient length to provide for between 2 and 3 hours of continuous bag production, after which the spent spool must be replaced with a new spool. Thus the spools are commonly changed several times during a normal production shift. Since the zipper is commonly formed of polyethylene or similar plastic material, it is easily twisted. Thus, during each change of the zipper spool there is the danger of the zipper spool being misoriented and, even if the spool is properly oriented there is the further danger of the zipper coming off the spool twisting prior to being attached. In either case the zipper could be applied with the easy-open side facing the bag interior and the reversal might not be detected until after the bag is filled and first opened by a consumer. This problem is exacerbated by the fact that in most form, fill and seal operations a tamper proof web spans across the lips of the bag. When in place, the web tends to hold the profiles closed even if they are reversed and subjected to forces that otherwise would pop the profiles open. However, once the consumer cuts the web, if the profiles are reversed the defect in the bag becomes evident by rendering the bag hard to open from the outside and having a tendency to pop open from the inside.

SUMMARY OF THE INVENTION

In view of the above, it is a principle object of the present invention to provide an improved string zipper for use in the manufacture of reclosable plastic bags wherein the zipper is provided with indicia of the proper orientation of the easy and/or hard opening sides.

A further object is to provide such indicia in a manner that is readily apparent during the manufacturing process in a production line environment.

A still further object is to provide such indicia in a manner than is not readily apparent in the final bag product and hence does not detract from the aesthetics of the final product.

Yet another object is to provide an improved method of manufacture of reclosable plastic bags that utilizes the improved string zipper.

The above and other beneficial objects and advantages are attained in accordance with the present invention by providing a zipper formed of complementary first and second profile strips. When interlocked, the first profile strip includes a portion defining the top side of the zipper (i.e. designed to be directed toward the bag opening) and the second profile strip includes a portion defining the lower most side of the zipper (i.e. designed to be directed toward the bag bottom). One of the profile strips includes indicia to distinguish that profile strip from the other profile strip. The indicia may, for example, comprise the addition of an optical brightener to the resin from which the profile was extruded or may consist of a stripe or line formed of resin containing the brightener. Such optical brighteners are ordinarily not visible under normal light conditions. However, when viewed under UV enriched light, commonly called "black" light, a distinctive difference becomes readily apparent between the profile strip formed from a resin to which the brightener was added and that formed from resin to which no brightener was added.

During the production of reclosable plastic bags the zipper is passed under a black light upstream of the point at which the zipper is attached to the sheet material, preferably immediately before such attachment. Under the black light the proper orientation of the zipper becomes readily apparent and suitable adjustments may be made to the zipper, by simply twisting the zipper, as required to ensure that the hard-to-open side is directed toward the bag bottom and the easy-to-open side is directed toward the bag top.

BRIEF DESCRIPTION OF THE DRAWINGS

In the accompanying drawings

Figure 1:
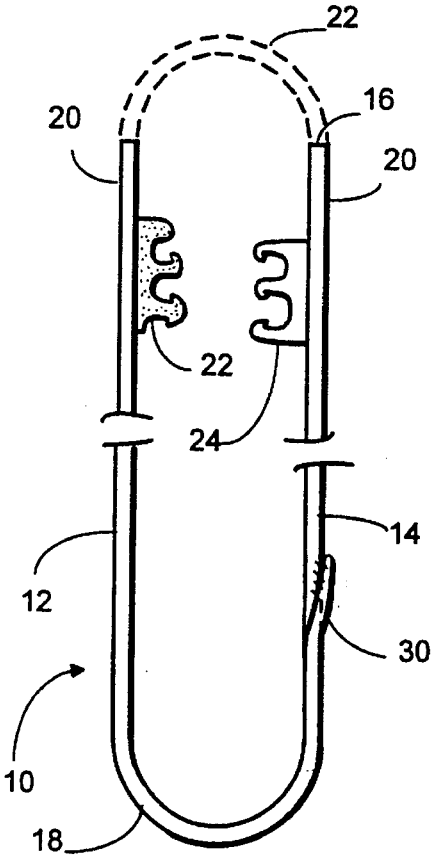
FIG. 1 is a side elevational view of a reclosable plastic bag provided with a zipper closure formed in accordance with the present invention.

DETAILED DESCRIPTION OF THE PREFERRED EMBODIMENT:

Reference is now made to the drawings and to FIG. 1 wherein a reclosable plastic bag 10 is depicted formed of a sheet of plastic material folded to define opposed side walls 12 and 14, a top end 16 and bottom end 18. The top of the bag is defined by opposed lips 20 which provide convenient pull flanges for the user of the bag to grip to open the bag. A web 22 of the plastic sheet material is often provided above the lips to provide evidence of tampering. That is, before the bag may be opened the web must be removed. Such webs are usually provided for bags formed by food processors on form/fill/seal equipment.

Figure 2:
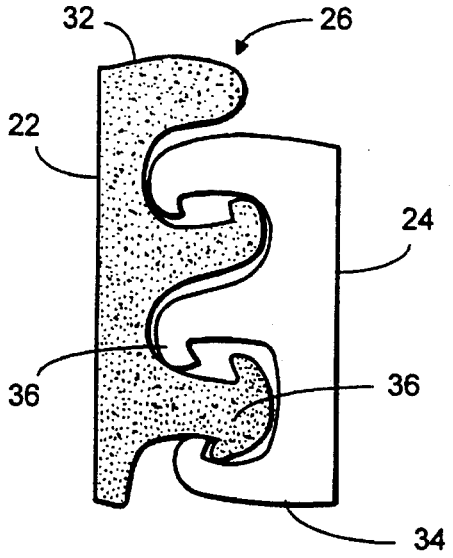
FIG. 2 is an enlarged side elevational view of a zipper in accordance with the present invention depicted with the profiles interlocked.
Figure 3:
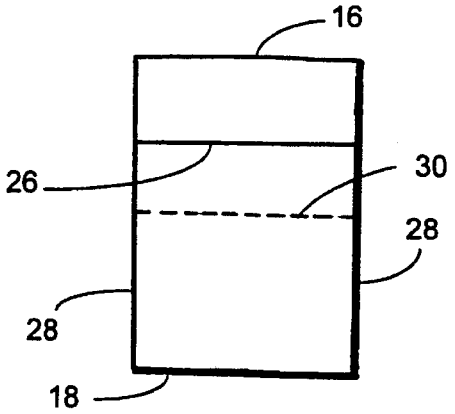
FIG. 3 is a front elevational view of the bag of FIG. 1 (with the profiles interlocked)
Figure 4:
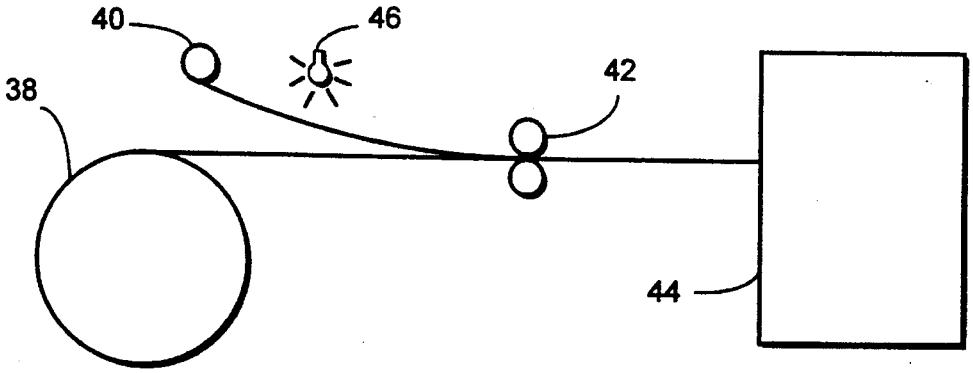
FIG. 4 is a schematic view of a reclosable plastic bag production line incorporating the present invention.

Mating interlocking profiles 22, 24 are provided on the plastic sheet material at the top of the bag 10 adjacent the bag lips 20. As shown in FIG. 2, the profiles define a zipper 26 by which the bag may be repeatedly closed and reopened. During formation of bags, sheet material is "U"-folded or "J"-folded and the folded material is formed into a series of bags by transversely cutting and sealing the tube along seams 28 and the free ends of the sheet material are sealed along a longitudinal seam 30 which may be at the bottom of the bag. The formation of sheet material into plastic bags is well defined and quite well known by those skilled in the art.

As shown in FIG. 2, the zipper 26 has a top most side portion defining an easy to open side 32 which must face the bag top and a bottom most side portion defining a hard to open side 34 which must face the bag interior. This results basically from the proximity of the engaging barbs of the mating profiles to the side 34 as well as their facing direction. Accordingly, it is important that the zipper 26 be attached to the plastic sheet material in a manner that will direct side 32 of profile 22 toward the bag top and side 34 of profile 24 toward the bag bottom.

Bearing in mind that the base of the profiles is approximately 0.250" it should be obvious that the differences in the zipper 26 when viewed from sides 32 and 34 while critical, is minute. To facilitate the distinction between profiles 22 and 24 one of the profiles (i.e. profile 22) is extruded from a polyethylene resin to which an optical brightener is added. Such brighteners are available, for example, as PM 1352E7 from Techner PM, Inc. of Rancho Dominquez, Calif. The active ingredient of the brightener is a benzoxazole which provides a fluorescence to the polyethylene resin of the profile. At low levels of UV light, such as is usually available in indoor or outdoor lighting, including fluorescent lighting, the addition of the brightener is not visible. However, when viewed under enhanced UV lighting, such as "black light" the addition of the brightener causes profile 32 to emit a distinctively bright color which may be used to readily distinguish profile 22 (and hence the edge at the easy to open side 32) from profile 24 (and hence the edge at the hard to open side 34). The brightener may be added to the entire profile 22 or just to the portion defining the leading edge 32.

During the production of reclosable plastic bags utilizing zipper 26, a spool 38 of sheet material and spool 40 of zipper are unwound at constant speed to feed to the zipper and film to a zipper joining station 42 upstream of the bag making equipment 44. The zipper joining station need not be located in the same plant as the bag making equipment in which case the zippered material (i.e. the sheet material having attached profiles) would have to be respooled and sent to the bag making facility. The zipper joining station 42 may utilize any of many available technologies, (such as utilizing sealing bars or rollers to fuse the zipper and film, adhesives, welding, etc.) to attach the zipper to the film. Upstream of the zipper attaching station 42) a black light 46 is provided through which the zipper 26 must pass prior to being brought onto the film. Because of the addition of the brightener to profile 22, the orientation of the zipper 26 may readily be detected and corrected (by simple twisting), as required, to obtain the proper orientation of the zipper on the film to ensure that side 32 of profile 22 will face the top of the completed bag.

Since the brightener is not visible under ordinary lighting conditions, its addition, does not effect the aesthetics of the final bag. Thus, in accordance with the above, the aforementioned objects are effectively attained. It will be understood that variations and modifications may be made effected without departing from the spirit and scope of the novel concepts of the present invention as set forth in the following claims.

Having thus described the invention, what is claimed is:

1. In a zipper for use in the manufacture of a reclosable plastic bag, said zipper being of the type having a first profile for attachment adjacent a pull flange area on one side wall of the bag at a top end of the bag and a complementary profile for attachment adjacent a corresponding pull flange area on an opposite side wall of the bag, said first and complementary profiles interlocking with each other in a manner so as to require less of a force to disengage the profiles when said force is applied to said pull flange areas than when said force is applied from within the bag, the improvement comprising, said profiles having edges directed toward and away from said pull flange areas:

indicia on at least a portion of one of the profiles indicative of the orientation of at least one of said edges of said one profile with respect to its associated pull flange area, said indicia not being visible unless viewed under ultraviolet light.

2. The zipper in accordance with claim 1 wherein when said profiles are interlocked said first profile includes a top most portion of said interlocked profiles and said complementary zipper includes a bottom most portion of said interlocked profiles, and said indicia serves to distinguish the top most portion of said interlocked profiles from the bottom most portion.

3. The invention in accordance with claim 1 wherein said zipper comprises a string zipper.

4. The zipper in accordance with claim 1 wherein said profiles are extruded of a thermoplastic resin and said indicia results from the addition of an optical brightener to the resin from which one of the profiles is extruded.

5. The zipper in accordance with claim 4 wherein said profiles are extruded of polyethylene and said optical brightener comprises a benzoxazole.

* * * * *